United States Patent [19]

Perry

[11] Patent Number: 4,802,813

[45] Date of Patent: Feb. 7, 1989

[54] APPARATUS TO BE USED IN CONJUNCTION WITH A FORKLIFT FOR LIFTING AND MOVING A CONCRETE SLAB

[76] Inventor: Charles C. Perry, 8513 Newcastle Ave., Northridge, Calif. 91325

[21] Appl. No.: 167,709

[22] Filed: Mar. 14, 1988

[51] Int. Cl.[4] ..... B66F 9/12

[52] U.S. Cl. ..... 414/607; 52/125.2; 294/89

[58] Field of Search ..... 414/607, 608, 912, 785; 294/81.1, 81.5, 81.6, 89; 52/125.3, 125.4, 125.5, 125.6

[56] References Cited

U.S. PATENT DOCUMENTS

| | | | |
|---|---|---|---|
| 2,589,342 | 3/1952 | Christensen . | |
| 2,690,271 | 9/1954 | Marietta . | |
| 2,735,563 | 2/1956 | Kelly . | |
| 3,180,513 | 4/1965 | Vander Wal . | |
| 3,229,836 | 1/1966 | Koenig . | |
| 3,264,026 | 8/1966 | Hansen . | |
| 3,499,676 | 3/1970 | Haeussler . | |
| 3,552,583 | 1/1971 | Toffolon . | |
| 4,087,947 | 5/1978 | Turner . | |
| 4,194,868 | 3/1980 | Walker . | |
| 4,604,839 | 8/1986 | Esposito | 52/125.5 |

FOREIGN PATENT DOCUMENTS

| | | | |
|---|---|---|---|
| 523044 | 4/1955 | Italy | 52/125.6 |

*Primary Examiner*—L. J. Paperner
*Assistant Examiner*—Gary Cundiff
*Attorney, Agent, or Firm*—Thomas I. Rozsa

[57] ABSTRACT

An elongated metal apparatus which comprises at least one longitudinal gripping member and preferably a pair of longitudinal gripping members in spaced apart relationship, which are anchored to a slab of concrete and can be used in conjunction with a forklift to physically lift and move the slab of concrete to another location to thereby expose the area beneath the concrete. The apparatus enables a user to remove a section of concrete without the necessity of breaking up and discarding the section of concrete and having to subsequently re-pour the concrete. The apparatus includes a central tunnel or channel for receiving a fork of a forklift, a pair of side members which permit the apparatus to be affixed to the concrete using anchor bolts, and a pair of covering members which cover the area of the anchor bolts to prevent then from flying out and injuring someone if one or more of the anchor bolts should shear loose during the lifting or moving process.

10 Claims, 2 Drawing Sheets

APPARATUS TO BE USED IN CONJUNCTION WITH A FORKLIFT FOR LIFTING AND MOVING A CONCRETE SLAB

BACKGROUND OF THE INVENTION

1. FIELD OF THE INVENTION

The present invention relates to the field of grip and hold structures which can be used in conjunction with a lifting and moving apparatus such as a forklift to physically lift and move large slabs of concrete and other heavy objects and in particular to remove poured concrete slabs from their location so that underlying structures become accessible.

2. DESCRIPTION OF THE PRIOR ART

In general, various types of apparatus used in conjunction with lifting and moving objects are known in the prior art. Applicant is aware of the following prior art patents which disclose various embodiments of apparatus used for lifting and moving.

1. U.S. Pat. No. 4,194,868 issued to Walker et al. in 1980 for "Valve Lifting Attachment For Fork Lift" discloses a lifting attachment for a forklift to enable the forklift to lift a plurality of heavy water valve assemblies. The device consists of an elongated beam to which is attached a multiplicity of chain and hook members to lift the valve assembly.

2. U.S. Pat. No. 4,087,947 issued to Turner in 1978 for "Edge-Lifting System For A Concrete Slab" discloses a lifting attachment to a concrete slab which must be inserted while the concrete is still wet after it has been poured. The apparatus is not functional for use with a hard concrete slab.

3. U.S. Pat. No. 3,552,583 issued to Toffolon in 1971 for "Panel Erection Apparatus" relates to a panel erection apparatus for lifting various types of panels. An integral portion of the apparatus requires that the frame members of the panel be exposed for gripping.

4. U.S. Pat. No. 3,499,676 issued to Haeussler in 1970 for "System For Manipulating Concrete Bodies" relates to an apparatus for moving concrete slabs which includes a ball and socket arrangement attached to an anchor bolt.

5. U.S. Pat. No. 3,264,026 issued to Hansen in 1966 for "Hook Attachment For A Fork Lift Vehicle" discloses a chain and hook member for lifting an article wherein the lifting member can be used in conjunction with the prongs of a forklift.

6. U.S. Pat. No. 3,229,836 issued to Koenig in 1966 for "Cement Sack Pallet And Handling Equipment" discloses a pallet for moving sacks of cement where the pallet has tunnels for receiving the prongs of a forklift.

7. U.S. Pat. No. 3,180,513 issued to Vander Wal in 1965 for "Attachment For Fork-Lift Trucks" discloses a pair of metal receiving member which are used to lift a wooden pallet. The receiving members are hingeably attached to the wooden pallet, so that it may be tipped by appropriate movement of the forklift prongs relative to the pallet.

8. U.S. Pat. No. 2,735,563 issued to Kelly in 1956 for "Running Board Handling Attachment For Lift Trucks" discloses an embodiment of a freight car running board lifting and handling device for use with a forklift.

9. U.S. Pat. No. 2,690,271 issued to Marietta in 1954 for "Attachment For Lift Trucks" discloses a specialized lifting attachment to be attached to the prongs of a forklift.

10. U.S. Pat. No. 2,589,342 issued to Christensen in 1952 for "Lift Truck Accessory" relates to an attachment to a forklift which permits the forklift to handle and dump the contents of large crates.

As can be seen from the above referenced prior art patents, previously known devices have the capability of lifting a preformed slab of concrete or panel member before it is installed in its final form. The lift means requires the ability to be able to grip an internal member (as in the Toffolon Patent) or alternatively requires that lifting means be inserted into the concrete while it is still wet and before it has hardened (as in the Turner Patent).

What is not known in the prior art is an apparatus by which a poured and hardened concrete slab which has been set in its final position on the ground may be picked up and safety moved to another location so that the area beneath the slab becomes accessible. The poured and affixed concrete slab is already hardened, and therefore it is not possible to set gripping means comparable to that disclosed in the Turner patent. Since the concrete slab only has the smooth upper surface (and possibly smooth sidewalls) exposed, there are no exposed beams for attachment by the apparatus in Toffolon. The system in Haeussler is unstable and provides no protection in the event the anchor bolt should sheer loose from the concrete slab due to the strain of its weight or the motion imparted to it.

Therefore, a significant need exists for an apparatus which can be securely attached to poured and hardened concrete which is in place on the ground and which can be used in conjunction with a lifting and moving means such as a forklift to lift and move the concrete slab so that the ground under the slab is exposed.

SUMMARY OF THE PRESENT INVENTION

The present invention relates to a novel apparatus which enables a user to grip and lift a section of concrete and move the slab of concrete to a different location.

It has been discovered, according to the present invention, that if at least one elongated metal member comprising a centrally disposed longitudinal channel which can accommodate a fork of a forklift is anchored to a slab of concrete, then the elongated metal member can be used in conjunction with a forklift to lift the slab of concrete and move it to another location.

It has also been discovered, according to the present invention, that if the elongated metal member further comprises a pair of flange member which include a multiplicity of spaced apart holes in the horizontal portion of the flange which rests adjacent the slab of concrete, then a multiplicity of anchor bolts or other gripping means can be inserted through selected openings and affixed within the slab of concrete to secure the elongated metal member to the concrete slab.

It has further been discovered that if the flanges which include the anchor bolts are covered with a secure covering member, then in the event one or more anchor bolts should shear loose from the concrete during the proces of lifting or moving the concrete, they will be prevented from flying out and possibly injuring someone.

It is an object of the present invention to enable a user to physically remove a large section of concrete from an area and relocate the section of concrete, thereby saving the effort of breaking up and discarding the old concrete from the initial location and requiring new concrete to be poured at the new location.

It is another object of the present invention to enable a user to obtain access to a portion of the area covered by a large concrete slab so that an object such as a valve or water pipe which is covered by the concrete becomes accessible, without the need to spend many man hours to break up the concrete covering the area and then subsequently remove and discard the broken concrete.

It is a further object of the present invention to avoid wastage by providing an apparatus which can physically pick of a free standing section of concrete or physically pick up a slab of concrete which has been cut from a larger portion and thereafter move the slab to a new location or remove the section of concrete for a period of time and return the concrete to its original location at a subsequent time.

It is also an object of the present invention to provide an apparatus which can be used in conjunction with a forklift to lift and remove the concrete slab.

It is another object of the present invention to provide an apparatus which can safely lift a heavy slab of concrete and provide safety means in the event one or more of the anchor bolts anchoring the lifting member to the concrete should shear loose from the concrete.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

DETAILED DESCRIPTION OF THE PREFERRED EMBODIMENTS

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 2:
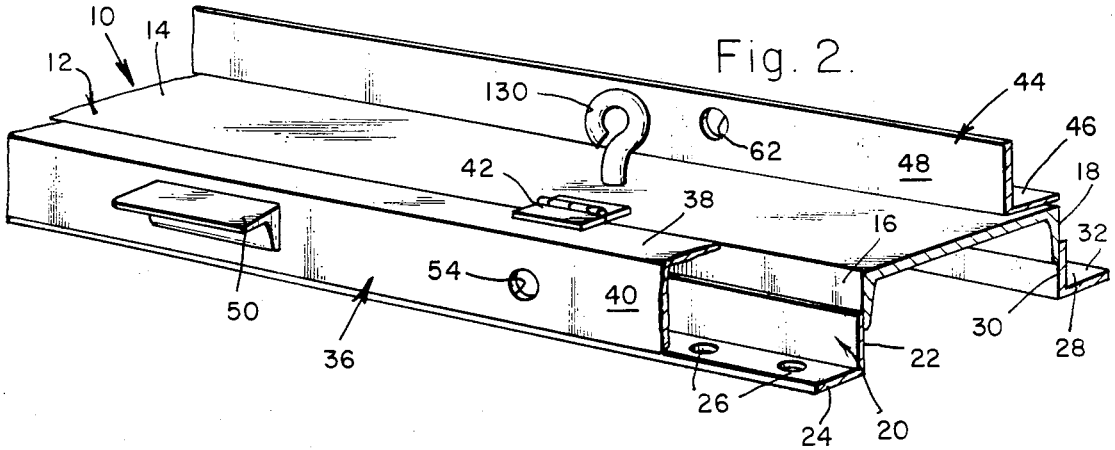
FIG. 2 is a perspective view of a longitudinal gripping member of the present invention.

Referring to the drawings of the invention and more particularly to FIG. 2, there is shown at 10 a perspective view of the longitudinal gripping member of the present invention. In the preferred embodiment, the longitudinal gripping member 10 is comprised a longitudinal top section 12 which includes a top portion 14, a first side 16 and a second side 18. The first and second sides 16 and 18 are disposed generally perpendicular to the top portion 14. Supporting the top section 12 are a pair of elongated flange members, 20 and 28. First elongated flange member 20 comprises an upright section 22 and a lateral section 24. Upright section 22 is attached to first side 16 along their respective lengths. Lateral section 24 further comprises a multiplicity of spaced apart openings 26 which extend through the entire thickness of the lateral section 24. Second elongated flange member 28 comprises an upright section 30 and a lateral section 32. Upright section 30 is attached to second side 18 along their respective lengths. Lateral section 32 further comprises a multiplicity of spaced apart openings 34 (see FIG. 4) comparable to the openings 26, which also extend through the entire thickness of the lateral section 32. It will be appreciated that although the preferred embodiment is comprised of three mainframe parts, a top portion 14, a first elongated flange member 20 and a second elongated flange member 28, it is within the spirit and scope of the present invention to make the Mainframe of one piece construction.

Figure 3:
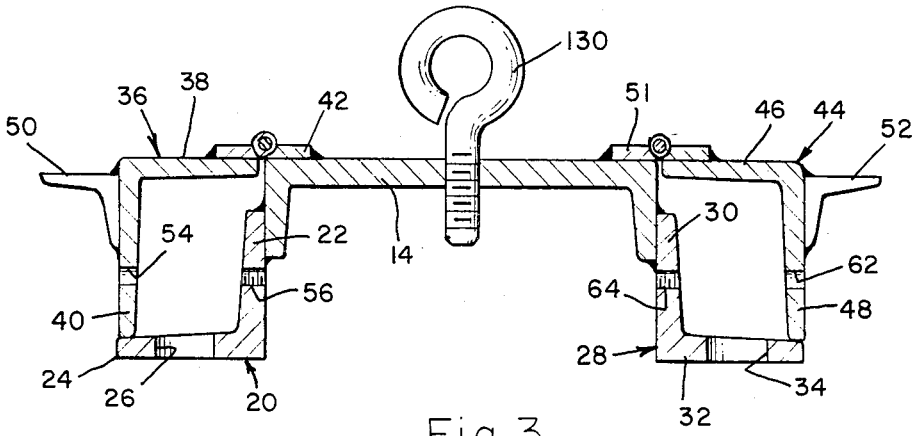
FIG. 3 is a cross-sectional view of a longitudinal gripping member of the present invention, with the housing members in the closed position.
Figure 4:
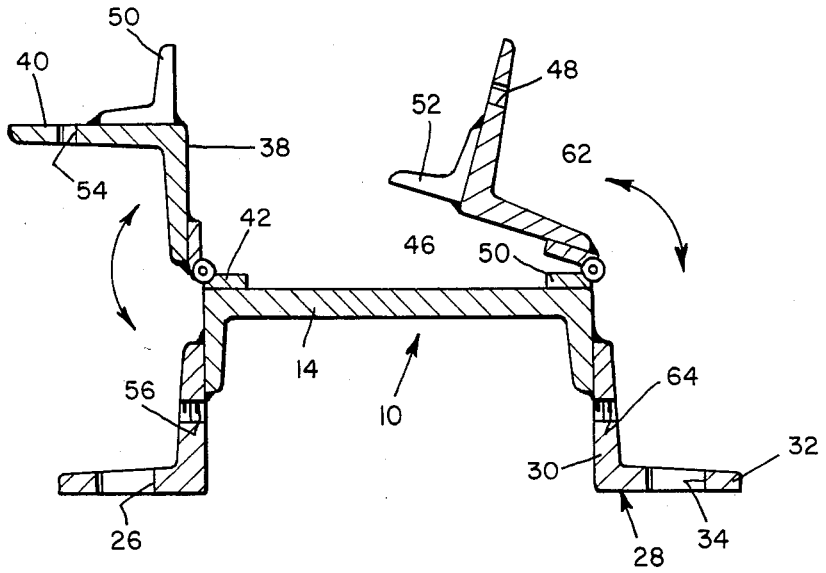
FIG. 4 is a cross-sectional view of a longitudinal gripping member of the present invention, with the housing members in the opened position.

Referring to FIG. 3 and 4, rotatably attached to the top portion 14 adjacent first side 16 is a first elongated cover member 36 which runs the length of the longitudinal gripping member 10. The first cover member 36 further comprises a lateral top portion 38 and an upright portion 40 generally perpendicular to the top portion 38. The top portion 38 of the cover member 36 is rotatably attached to the top portion 14 of top section 12 by at least one attachment means such as hinge member 42. In the preferred embodiment, two attachment means 42 are used to rotatably connect the parts.

Rotatably attached to the top portion 14 adjacent second side 18 is a second elongated cover member 44 which runs the length of the longitudinal gripping member 10. The second cover member 44 further comprises a lateral top portion 46 and an upright portion 48 generally perpendicular to the top portion 46. The top portion 46 of the cover member 44 is rotatably attached to the top portion 14 of top section 12 by at least one attachment means such as hinge member 51. In the preferred embodiment, two attachment means 51 are used to rotatably connect the parts.

As illustrated in FIGS. 2 through 4, the first cover member 36 and the second cover member 44 can be rotated via their respective hinge members 42 and 51 such that openings (26 and 34 respectively) are fully exposed so that objects may be inserted through them. In the view in FIG. 4, one cover member is shown rotated by approximately 90 degrees and the other cover member is shown rotated by approximately 135 degrees. It will be appreciated that each cover member can be rotated by approximately 180 degrees to fully expose the openings. When cover member 36 is rotated approximately 180 degrees in the counterclockwise direction, then top portion 38 extends laterally and generally parallel to lateral section 24 and upright portion 40 extends vertically and generally parallel to said first upright section 22 of said first elongated flange member 20 and touches lateral section 24 so as to form a closed housing. To assist in this rotation, optional handle member 50 attached to upright portion 40 may be used. To assure that the housing will remain closed, upright portion 40 comprises at least one opening 54 and upright section 22 comprises at least one opening 56 generally parallel to opening 54 so that bolt 60 may be inserted therethrough (see FIG. 5). It will be appreciated that any multiplicity of comparable sets of holes and a bolt through each such set may be embodied within the present invention. When cover member 44 is rotated approximately 180 degrees in the clockwise direction, then top portion 46 extends laterally and generally parallel to lateral section 32 and upright portion 48 extends vertically and generally parallel to said second upright section 30 of said second elongated flange member 28 and touches lateral section 32 so as to form a closed housing. To assist in this rotation, optional handle member 52 attached to upright section 48 may be used. To assure that the housing will remain closed, upright portion 48 comprises at least one opening 62 and upright section 30 comprises at least one opening 64 generally parallel to opening 62 so that bolt 70 may be inserted therethrough (see FIG. 5). It will be appreciated that any multiplicity of comparable sets of holes and a bolt through each such set may be embodied within the present invention.

Figure 1:
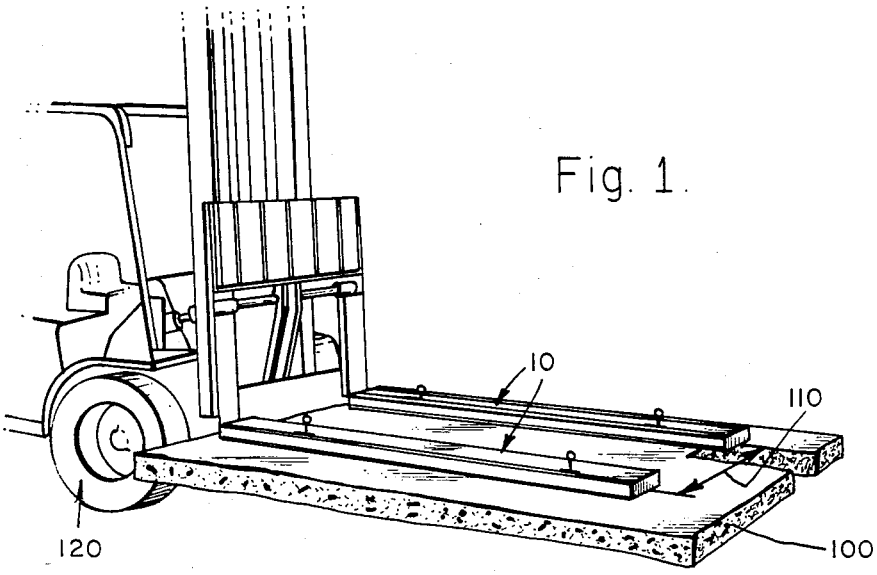
FIG. 1 is a perspective view of a pair of longitudinal gripping memebers of the present invention anchored to a slab of concrete and being used in conjunction with a forklift to lift the slab of concrete.

Referring to FIG. 1, while a slab of concrete may be lifted using only one longitudinal gripping member 10, in the preferred embodiment of the present invention, a pair of longitudinal gripping members 10 are affixed to a concrete slab 100 with the distance 110 between the longitudinal centerlines of the gripping members 10 being approximately equal to the distance between the longitudinal centerlines of the two prongs or forks of a forklift 120.

Figure 5:
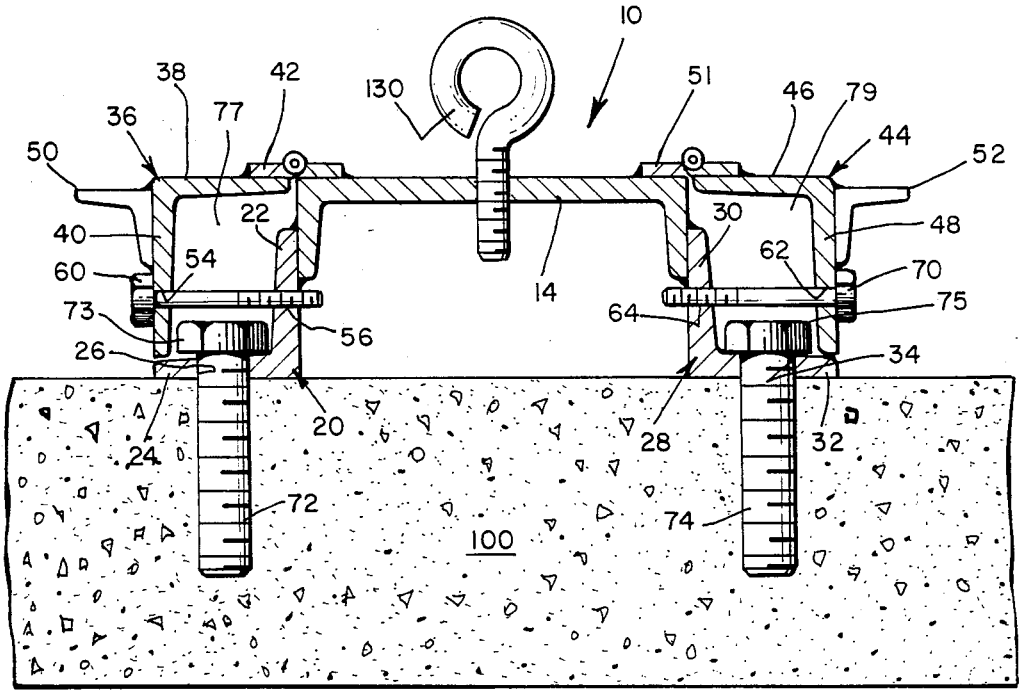
FIG. 5 is a cross-sectional view of a longitudinal gripping member of the present invention showing the longitudinal gripping member anchored to a section of concrete slab through anchoring bolts.

As illustrated in FIG. 5, a longitudinal gripping member 10 is affixed to a concrete slab 100 by inserting at least one gripping means such as anchor bolt 72 through an opening 26 in lateral section 24 and drilling it into the concrete slab until it becomes wedged into the concrete slab 100; and by further inserting at least one gripping means such as anchor bolt 74 through an opening 34 in lateral section 32 and drilling it into the concrete slab until it becomes wedged into the concrete slab 100. In the preferred embodiment, a multiplicity of anchor bolts 72 and 74 are inserted through holes 26 and 34 respectively at spaced apart locations along the length of lateral sections 24 and 32 respectively. It will be appreciated that immediately prior to inserting the anchor bolts and drilling them into the concrete, the cover members 36 and 44 are rotated into the "open" position as shown in FIG. 4. and after all of the anchor bolts are affixed into the concrete slab 100, the cover members 36 and 44 are rotated back into the "closed" position shown in FIGS. 3 and 5. Fastening means such as bolts 60 and 70 are then inserted through the spaced apart parallel holes as previously described to lock the covers in place.

Described in slightly broader terms, the present invention is an apparatus to be used in conjuction with a forklift for lifting and moving a concrete slab, comprising: (a) an elongated housing member defined by a top section, a pair of sidewalls attached at either end of said top section, and a pair of outwardly protruding floor members with one floor member attached to the end of a respective sidewall remote from said top section and which extend generally parallel to said top section and away from the top section and away from the sidewall to which it is attached; (b) an interior channel defined by said top section and said pair of sidewalls; (c) a multiplicity of spaced apart openings in each of said pair of floor members; (d) a multiplicity of anchor bolts inserted through said spaced apart openings such that one anchor bolt is inserted through a selected one of the spaced apart openings; (e) a first rotatable cover member enclosing a sidewall and its adjacent floor member; (f) said first rotatable cover member being rotatable to permit access to the openings in its adjacent floor member, and define an opened position; (g) a second rotatable cover member enclosing the other sidewall and its adjacent floor member; (h) said second rotatable cover member being rotatable to permit access to the openings in its adjacent floor member, and define an opened position; (i) a first securing means to maintain said first cover in a closed position enclosing a sidewall, its adjacent floor member and a multiplicity of anchor bolts; and (j) a second securing means to maintain said second cover in a closed position enclosing a sidewall, its adjacnet floor member and a multiplicity of anchor bolts; (k) whereby said apparatus is attached to said concrete slab through said multiplicity of anchor bolts extending through the openings in the floor members and affixed into the concrete slab while said first and second covers are in the opened position and thereafter the first and second covers are rotated into the closed position and fastened closed and said concrete slab is raised and moved by inserting a fork of a forklift through said interior channel and causing the fork to move upwardly on the forklift.

In operation for most large slab embodiments, two longitudinal gripping members 10 are affixed to the concrete slab 100 in manner just described and spaced apart such that the distance 110 between their longitudinal centerlines is approximately equal to the distance between the longitudinal centerlines of the pair of forks of a forklift 120. The forklift 120 is then positioned such that a respective fork is moved through the tunnel or longitudinal opening 15 formed by the top section 12 (including top portion 14 and sides 16 and 18) and by upright section 22 of first flange member 20 and upright section 30 of second flange member 28, of a respective longitudinal gripping member 10. The forks are then raised such that each fork pulls upwardly on a respective longitudinal gripping member 10 and causes the concrete slab 100 to be moved upwardly off the ground. In the event that an anchor bolt should shear loose, the bolt is prevented from flying out and hurting someone through the closed and locked cover which encloses the head of the bolt within the space bounded by a cover and its respective flange member. Referring to FIG. 5, head 73 of bolt 72 is enclosed within the space 77 bounded by cover 36 and flange 20. Similarly head 75 of bolt 74 is enclosed within space 79 bounded by cover 44 and flange 28.

It will be appreciated that the present invention longitudinal gripping member 10 provides a significant advantage over prior art apparatus for moving a slab of concrete. The present invention longitudinal gripping member 10 can be used to move a free standing slab of concrete, or alternatively can be used to move a section of a large concrete area. In this case, the section which must be moved is cut perpendicularly along its four sidse so that it is physically separated from the remainder of the concrete. With the longitudinal gripping members 10 being inserted as previously discussed, the forklift can be driven across the remaining portion of concrete and positioned such that the forks are inserted into the longitudinal gripping members as previously discussed. The slab can thereby be picked up and the forklift is driven away from the sight to expose the ground beneath the removed slab. In this way, the portion of concrete covering an area to which access is required (for example a broken section of pipe or a water valve) can be removed without the necessity of breaking up the concrete. In this way, after the activity for which access was required (such as fixing the pipe or the valve) is completed, the forklift can be driven back into position and the concrete slab lowered back into the arae from which it was removed. As a result, the operation of fixing something under a concrete slab or section or concrete can be very efficiently performed without the necessity of breaking up the concrete and re-pouring the concrete after the work is completed.

The slab may remain suspended on the forklift after it has been removed from the site. Alternatively, the concrete slab can be lowered onto the bed of a flatbed truch and either hauled away or left there and subsequently removed from the bed of the flatbed truck and returned to the site after work on the components located in the exposed area has been completed.

It will be further appreciated that the present invention permits the removal of any slab of concrete and it is not necessary for there to be any exposed beam or rod to be gripped. Further, it is not necessary that the slab be in a free standing state before removal. The combination of the opening through which the fork of a forklift may be inserted combined with the fixtures for holding the spaced apart anchor bolts and protective housing covering the anchor bolts to permit the longitudinal gripping member 10 to be affixed to any slab of concrete for subsequent moving of the concrete.

By way of example, all portions of the longitudinal gripping means 10 including top 12, flanges 20 and 28 and covers 36 and 44 can be made of heavy gauge steel such as one-half inch steel. The flanges 20 and 28 and covers 36 and 44 may also be made of angle iron steel. The hinges 42 and 50 may also be made of steel. By way of example, the longitudinal gripping member can be approximately 8 feet long.

It will also be appreciated that if an exceptionally long slab of concrete is to be lifted and moved, two sets of concrete gripping members 10 can be affixed at opposite ends of the concrete slab and two forklifts, one on each end would be used. One forklift would be used to insert its forks in one set of concrete gripping members 10 at one end and the other forklift would be used to insert its forks in the second set of concrete gripping members 10 at the other end. Then the concrete slab would be lifted off the ground by both forklifts being operated simultaneously and the forks of the two forklifts raised in unison.

It will also be appreciated that while use of a pair of concrete gripping members 10 is the preferred embodiment since it lends balance as well as additional lifting capability; for smaller pieces of concrete a single concrete gripping member and a single fork of the forklift can be used. The longitudinal gripping member 10 is affixed to the concrete slab, as previously discussed, and the smaller slab is raised with one fork of the forklift inserted into tunnel 15 of the longitudinal gripping member 10. Due to balancing problems, this can only be effectively performed with a slab that is not very wide.

Another optional feature of the present invention is the inclusion of at least one eyebolt 130 affixed along the longitudinal centerline of the lateral top portion 14 of top 12 (see FIG. 3). A hook and chain and additional lifting derrick can be used in conjunction with the forklift to lift exceptionally heavy piece of concrete.

The inventor has experimented with the apparatus as shown and disclosed. In one experimental example used to remove a 10 foot by 10 foot slab of concrete from an area to reach a broken water valve beneath the concrete, in ordinary operation it took 4 men approximately 6 to 8 hours to break up and remove the concrete. By comparison, using the present invention, it took 2 men only 2 hours to cut and remove the entire slab, which was subsequently reinserted back into the space after the repair work on the valve was completed.

The present invention concrete lifting device is a unique concept in many respects. The following are benefits and reasons for the development of the lifting device:

1. The use of the lifting device gives its user substantial savings in labor and equipment. The concept of reusing the conrete eliminates expensive steps to jack hammer the slab, load and haul the discarded concrete, and form and re-pour a new concrete slab. Each step represents substantial savings to the user.
2. Additional savings are realized by not having to pay for new concrete to re-pour the removed section.
3. Reduction of noise pollution associated with jack hammers and other heavy equipment.
4. Reduction of heavy dust pollution and its hazards to the user's health.
5. Environmental conservation is the most valuable benefit.
   A. Recycled concrete slabs will eliminate futher overfilling of our landfill dumps.
   B. Recycled concrete will insure that either colored concrete or natural toned concrete is replaced with the color preserved. Architectural beauty will be preserved by replacing the original color tone, rather than unsuccessful color matching of new concrete.
   C. The conservation of raw materials used in the making of new concrete is saved by recycling the concrete.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of a operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit to broad features or principles of the invention, or the scope of patent monopoly to be granted.

What is claimed is:

1. An apparatus to be used in conjunction with a forklift for lifting and moving a concrete slab, comprising:

a. a longitudinal top section;

b. said longitudinal top section further comprising a top portion, a first side and a second side, with each side being disposed generally perpendicular to the top portion;

c. a first elongated flange member comprising a first upright section and a first lateral section generally perpendicular to each other;

d. said first upright section attached to said first side of said longitudinal top section along their respective lengths such that said first lateral section is generally parallel to said top section and extends away from said first side and said longitudinal top section;

e. a second elongated flange member comprising a second upright section and a second lateral section generally perpendicular to each other;

f. said second upright section attached to said second side of said longitudinal top section along their respective lengths such that said second lateral section is generally parallel to said top section, extends away from said second side and said longitudinal top section, and is on the same level as said first lateral section;

g. said longitudinal top section and said first and second upright sections defining the walls of a longitudinal interior channel;

h. said first lateral section further comprising a multiplicity of spaced apart openings;

i. said second lateral section further comprising a multiplicity of spaced apart openings;

j. a first elongated cover member rotatably attached to said top section and comprising a first lateral top portion and a first upright portion disposed generally perpendicular to the first lateral top portion;

k. a second elongated cover member rotatably attached to said top section and comprising a second lateral top portion and a second upright portion disposed generally perpendicular to the second lateral top portion;

l. a first multiplicity of anchor bolts, with each one anchor bolt inserted through an opening in said first lateral section;

m. a second multiplicity of anchor bolts, with each one anchor bolt inserted through an opening in said second lateral section;

n. said first elongated cover member being rotatable such that said multiplicity of spaced apart openings in said first lateral section are exposed to permit insertion of said first multiplicity of anchor bolts, to thereby define an open position;

o. said second elongated cover member being rotatable such that said multiplicity of spaced apart openings in said second lateral section are exposed to permit insertion of said second multiplicity of anchor bolts, to thereby define an open position;

p. said first elongated cover member being rotatable such that said first lateral top portion is generally parallel to said first lateral section of said first elongated flange member and said first upright portion is generally parallel to said first upright section of said first elongated flange member, to thereby define a closed position;

q. fastening means to maintain said first elongated cover member in the closed position;

r. said second elongated cover member being rotatable such that said second lateral top portion is generally parallel to said second lateral section of said second elongated flange member and said second upright portion is generally parallel to said second upright section of said second elongated flange member, to thereby define a closed position; and s. fastening means to maintain said second elongated cover member in the closed position;

t. whereby said apparatus is attached to said concrete slab through said first multiplicity of anchor bolts extending through the openings in said first lateral section and affixed into the concrete slab while said first cover is in the opened position and said second multiplicity of anchor bolts extending through the openings in said second lateral section and affixed into the concrete slab while said second cover is in the opened position and thereafter the first and second covers are rotated into the closed position and fastened closed and said concrete slab is raised and moved by inserting a fork of a forklift through said interior channel and causing the fork to move upwardly on the forklift.

2. The invention in accordance with claim 1 further comprising a pair of apparatus disposed in spaced apart parallel relationship along their respective lengths with the longitudinal centerlines of each channel set apart by a distance approximately equal to the distance between the longitudinal centerlines of a pair of forks on a forklift; whereby both apparatuses are attached to said slab of concrete through the multiplicity of anchor bolts extending through the openings in said first lateral section and the openings in said second lateral section of each apparatus and affixed into the concrete slab and said concrete slab is raised and moved by inserting the two prongs on the forklift into said apparatuses such that one prong lies within a respective interior channel of one of the apparatuses and causing the forks to move upwardly on the forklift.

3. The apparatus in accordance with claim 1 wherein said apparatus is made of metal.

4. The apparatus in accordance with claim 1 further comprising at least one eyebolt affixed to said top section.

5. The apparatus in accordance with claim 1 wherein said first cover is rotatably attached by at least one hinge and said second cover is rotatably attached by at least one hinge.

6. An apparatus to be used in conjunction with a forklift for lifting and moving a concrete slab, comprising:

a. an elongated housing member defined by a top section, a pair of sidewalls attached at either end of said top section, and a pair of outwardly protruding floor members with one floor member attached to the end of a respective sidewall remote from said top section and which extend generally parallel to said top section and away from the top section and away from the sidewall to which it is attached;

b. an interior channel defined by said top section and said pair of sidewalls;

c. a multiplicity of spaced apart openings in each of said pair of floor members;

d. a multiplicity of anchor bolts inserted through said spaced apart opening such that one anchor bolt is inserted through a selected one of the spaced apart openings;

e. a first rotatable cover member enclosing a sidewall and its adjacent floor member;

f. said first rotatable cover member being rotatable to permit access to the openings in its adjacent floor member, and define an opened position;

g. a second rotatable cover member enclosing the other sidewall and its adjacent floor member;

h. said second rotatable cover member being rotatable to permit access to the openings in its adjacent floor member, and define an opened position;

i. a first securing means to maintain said first cover in a closed position enclosing a sidewall, its adjacent floor member and a multiplicity of anchor bolts; and j. a second securing means to maintain said second cover in a closed position enclosing a sidewall, its adjacent floor member and a multiplicity of anchor bolts;

k. whereby said apparatus is attached to said concrete slab through said multiplicity of anchor bolts extending through the openings in the floor members and affixed into the concrete slab while said first and second covers are in the opened position and thereafter the first and second covers are rotated into the closed position and fastened closed and said concrete slab is raised and moved by inserting a fork of a forklift through said interior channel and causing the fork to move upwardly on the forklift.

7. The invention in accordance with claim 6 further comprising a pair of apparatus disposed in spaced apart parallel relationship along their respective lengths with the longitudinal centerlines of each channel set apart by a distance approximately equal to the distance between the longitudinal centerlines of a pair of forks on a forklift; whereby both apparatuses are attached to said slab of concrete through said multiplicity of anchor bolts extending through the openings in the floor members and affixed into the concrete slab and said concrete slab is raised and moved by inserting the two prongs on the forklift into said apparatuses such that one prong lies within a respective interior channel of one of the apparatuses and causing the forks to move upwardly on the forklift.

8. The apparatus in accordance with claim 6 wherein said apparatus is made of metal.

9. The apparatus in accordance with claim 6 further comprising at least one eyebolt affixed to said top section.

10. The apparatus in accordance with claim 6 wherein said first cover is rotatably attached by at least one hinge and said second cover is rotatably attached by at least one hinge.

* * * * *